US010343259B2

(12) United States Patent
Traini et al.

(10) Patent No.: US 10,343,259 B2
(45) Date of Patent: Jul. 9, 2019

(54) WATER-JET OPERATING HEAD FOR CUTTING MATERIALS WITH A HYDRO-ABRASIVE HIGH PRESSURE JET

(71) Applicant: Biesse S.p.A., Chiusa di Ginestreto (Pesaro Urbino) (IT)

(72) Inventors: Matteo Traini, Chiusa di Ginestreto (IT); Marco Belli, Chiusa di Ginestreto (IT)

(73) Assignee: Biesse S.p.A., (Pesaro Urbino) (IT)

( * ) Notice: Subject to any disclaimer, the term of this patent is extended or adjusted under 35 U.S.C. 154(b) by 607 days.

(21) Appl. No.: 14/270,462

(22) Filed: May 6, 2014

(65) Prior Publication Data

US 2014/0329445 A1 Nov. 6, 2014

(30) Foreign Application Priority Data

May 6, 2013 (IT) ..... TO2013A0363

(51) Int. Cl.

| | |
|---|---|
| ***B24C 5/04*** | (2006.01) |
| ***B26F 3/00*** | (2006.01) |
| ***B24C 1/04*** | (2006.01) |

(52) U.S. Cl.

CPC ..... *B24C 5/04* (2013.01); *B24C 1/045* (2013.01); *B26F 3/004* (2013.01); *Y10T 29/4973* (2015.01)

(58) Field of Classification Search

CPC ..... B24C 5/04; B24C 1/045; B26F 3/004

(Continued)

(56) References Cited

U.S. PATENT DOCUMENTS 2,333,264 A * 11/1943 McDermott ..... B24C 5/04 451/102
2,717,476 A * 9/1955 Myers ..... B24C 5/04 451/102

(Continued)

FOREIGN PATENT DOCUMENTS

| | | |
|---|---|---|
| EP | 1004393 A2 | 5/2000 |
| EP | 2108475 A1 | 10/2009 |
| EP | 2584419 A2 | 4/2013 |

OTHER PUBLICATIONS

Italian Search Report, dated Dec. 5, 2013.
European Patent Office, Communication of Notice of Opposition, dated Jun. 22, 2016.

*Primary Examiner* — Monica S Carter
*Assistant Examiner* — Marcel T Dion
(74) *Attorney, Agent, or Firm* — Young Basile Hanlon & MacFarlane, P.C.

(57) ABSTRACT

A water-jet operating head for cutting materials by a high pressure hydro-abrasive jet includes a main portion which is to be carried by an operating machine movably along one or more axes and a focusing nozzle for ejecting the high pressure hydro-abrasive jet, carried by a support removably connected to the main portion of the head. This support also carries a primary nozzle with an orifice having a predetermined diameter arranged upstream of the focusing nozzle. The high pressure water jet is added with an abrasive agent which is fed through at least one connecting element at a mixing chamber interposed between the primary nozzle and the focusing nozzle. The connecting element is associated to the main portion of the head and the nozzle-carrying support is adapted to be slidably received within a cylindrical cavity of a main support forming part of the main portion of the head.

17 Claims, 4 Drawing Sheets

(58) Field of Classification Search
USPC ..... 451/102
See application file for complete search history.

(56) References Cited

U.S. PATENT DOCUMENTS 3,228,147 A * 1/1966 Moore ..... B24C 5/04 451/102
4,139,222 A * 2/1979 Loland ..... F16L 33/221 285/12
4,478,368 A * 10/1984 Yie ..... B05B 7/1431 239/430
4,545,157 A * 10/1985 Saurwein ..... B24C 5/04 239/430
4,555,872 A 12/1985 Yie
4,817,874 A * 4/1989 Jarzebowicz ..... B05B 7/04 239/434
4,872,615 A * 10/1989 Myers ..... B24C 5/04 239/587.4
5,144,766 A 9/1992 Hashish et al.
5,320,289 A 6/1994 Hashish et al.
5,643,058 A * 7/1997 Erichsen ..... B24C 1/045 451/100
5,765,759 A * 6/1998 Bruns ..... A61C 3/025 239/398
5,794,858 A * 8/1998 Munoz ..... B05B 15/065 239/433
5,851,139 A * 12/1998 Xu ..... B24C 5/04 239/433
6,715,701 B1 * 4/2004 Julien ..... B05B 1/10 239/429
8,425,280 B2 * 4/2013 Siepi ..... B24C 5/02 451/101
2008/0032610 A1 * 2/2008 Chacko ..... B24C 1/045 451/102
2009/0318064 A1 * 12/2009 Hashish ..... B24C 1/045 451/36
2011/0086579 A1 * 4/2011 Gelbart ..... B24C 1/045 451/40
2013/0112779 A1 * 5/2013 Giovannini ..... B05B 1/3415 239/488

* cited by examiner

WATER-JET OPERATING HEAD FOR CUTTING MATERIALS WITH A HYDRO-ABRASIVE HIGH PRESSURE JET

TECHNICAL FIELD

The present invention relates to water-jet operating heads using a high pressure hydro-abrasive jet, for cutting various materials, such as glass, stone, marble, metals, plastic materials, ceramic materials or in general any other material suitable to be worked by the above mentioned technology.

BACKGROUND

Operating heads of the above indicated type are to be used on machines in which the operating head is movable along one or more axes by means of electronically controlled motor means in order to perform cutting operations on pieces arranged on the machine table. In machines of this type the addition of the abrasive agent to the high pressure water jet enables cutting operations to be performed also on materials of medium and high hardness, and in general on all those materials for which cutting by a pure water jet is not possible.

The invention relates to a water-jet operating head of the known type including:

- a head main portion, intended to be mounted on an operating machine, and defining an axial passage for feeding a high pressure water flow,
- a nozzle carrying support which is removably connected to the head main portion,
- a jet focusing nozzle, for emitting a high pressure hydro-abrasive jet, mounted on said nozzle-carrying support and defining an ejection passage which is arranged downstream of said feeding passage and is in communication therewith,
- a primary nozzle carried by said nozzle-carrying support upstream of the focusing nozzle and having a body with an orifice of predetermined diameter interposed in the communication between the water flow feeding passage and the hydro-abrasive jet ejecting passage, and
- at least one connecting element carried by said head, through which an abrasive agent can be fed into the high pressure water flow at a mixing chamber defined within the nozzle-carrying support, between the primary nozzle and the focusing nozzle.

Machines provided with operating heads of the above indicated type have been produced and marketed for some time by the same Applicant.

A problem which is encountered in the operating heads of the above described type lies in the wear of the components inside the head through which the high pressure jet flows, as well as in the wear of some parts in which also the added abrasive flows. This causes an enlargement of those passages, with a resulting decrease of effectiveness and precision in the cutting operation. The parts which are more subject to wear are the above mentioned focusing nozzle and the primary nozzle. The focusing nozzle has the function of focusing a coherent jet of water and abrasive which is projected against the piece surface to cut the material being worked. The primary nozzle, along with its orifice of predetermined reduced diameter, has the function of accelerating the water jet and is arranged and self-centered inside the nozzle-carrying support. Between the primary nozzle and the focusing nozzle there is interposed a mixing chamber where the water jet is added with abrasive sand. The primary nozzle, the nozzle-carrying support along with the mixing chamber and the focusing nozzle are partly or completely preassembled with each other.

During use of the machine, it is necessary to periodically replace the above mentioned parts of the head which are subject to wear in order to always ensure the requested effectiveness and precision of the cutting operations.

Water-jet heads of various types are known, for example in U.S. Pat. No. 4,555,872. In this known solution, the operations for replacing the parts subject to wear and particularly the nozzle, are time-consuming, cumbersome and not adapted to be automated.

SUMMARY OF THE INVENTION

An object of the present invention is that of providing a water-jet operating head of the above indicated type in which those parts which are subject to wear can be replaced with simple and quick operations, preferably also in an automated manner, so as to reduce to a minimum the time requested for the replacement operation, increasing thereby the productivity of the machine.

A further object of the invention lies in the provision of an operating water-jet head which achieves the above indicated purpose with a simple and relatively inexpensive structure.

In view of achieving these objects, the present invention provides a water-jet operating head having the features indicated as claimed.

Due to the above mentioned features, the operation for replacing the nozzle-carrying support, along with the mixing chamber, the primary nozzle and the focusing nozzle associated thereto can be carried out simply and rapidly and if necessary also in an automated manner (which is not possible instead in the known solution of U.S. Pat. No. 4,555,872, due to the threaded couplings between the components of the head).

Naturally, within the scope of the invention defined thereby also fall equivalent solutions, such as that in which the coupling between the nozzle-carrying support and the main support of the head includes a cavity in the nozzle-carrying support which receives the body of the head main support therewithin.

Preferably, the above mentioned connecting element is carried by said main support and is in communication with an auxiliary passage defined by two substantially radial holes, aligned with each other, which are respectively formed in said main support and in said nozzle-carrying support. The main support and the nozzle-carrying support are further provided with mutual engagement means cooperating with each other for defining the proper coupling position in which said holes are aligned with each other. This result can be obtained also providing the cavity which receives the nozzle-carrying support with a non-circular cross-section and providing a corresponding cross-section also for the nozzle-carrying support, which is received within this cavity.

In a preferred embodiment, the cylindrical body of the nozzle-carrying support has a conical centering end for facilitating insertion of the nozzle-carrying support within said cylindrical cavity of the main support.

The head can be provided with two connecting elements, for feeding abrasive material, which are diametrically opposite to each other.

BRIEF DESCRIPTION OF THE FIGURES

Further features and advantages of the invention will become apparent from the following description with reference to the annexed drawings, given purely by way of non limiting example, in which.

DETAILED DESCRIPTION

Figure 1:
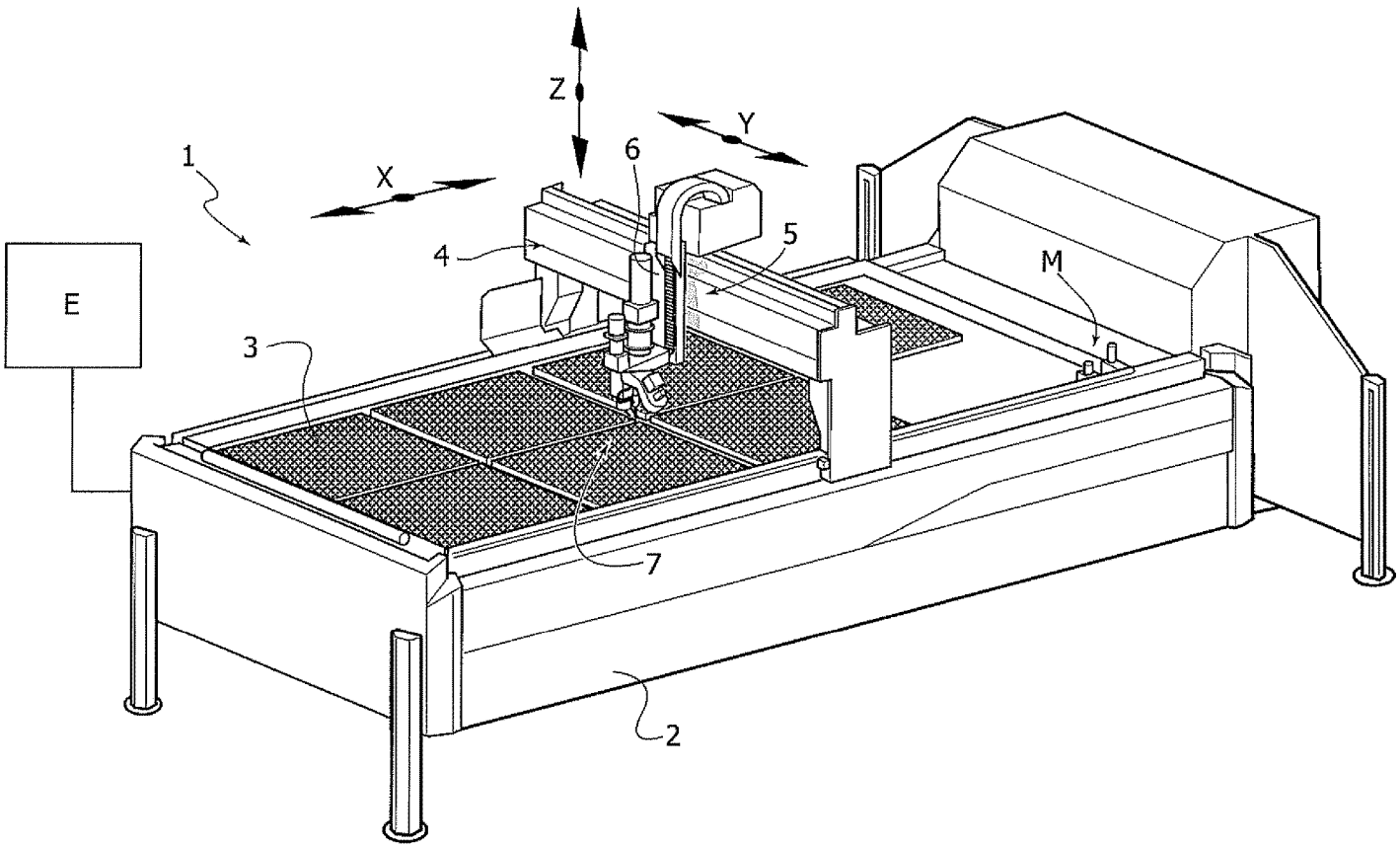
FIG. 1 is a diagrammatic perspective view of a machine for performing cutting operations with the water-jet technology.

With reference to FIG. 1, numeral 1 generally designates a machine for cutting operations with a hydro-abrasive jet. Machine 1 comprises a fixed bench 2 defining a support board 3 for the pieces to be worked. A cross-member 4 is arranged above board 3 and has its ends slidably mounted along the two flanks of bench 2 along a direction X. Reference numeral 5 designates a carriage slidably mounted on cross-member 4 along the longitudinal direction Y of the cross-member. A slide 6 carrying a water-jet operating head which is generally designated by reference numeral 7 is slidably supported along a vertical axis Z by carriage 5. The movements of head 7 along the three axes X, Y, Z are driven by respective electric motors (not shown) controlled by the electronic unit E of the machine.

By way of example, FIG. 1 shows the case of a head 7 with five axes, that is of the type in which head 7 can be moved, not only along the above mentioned three axes X, Y, Z, but also around two further rotational axes, in order to incline the head nozzle according to an angle which can be varied with respect to the vertical direction, with the further possibility of rotating the nozzle inclined thereby around the vertical axis. The details relating to the drive of the two above mentioned further axes of the machine are not provided herein, since they can be made in any known way and also because this aspect, taken alone, does not fall within the scope of the present invention, and it is clearly evident that the operating head according to the invention is applicable both to the case of three axis heads as well as to the case of five axis heads.

The machine illustrated in FIG. 1 is described herein only by way of example. Indeed the machine may have any different configuration, with a different type of piece-carrying board, also including the case of a movable board, and with a different orientation of cross-member 4.

Figure 2:
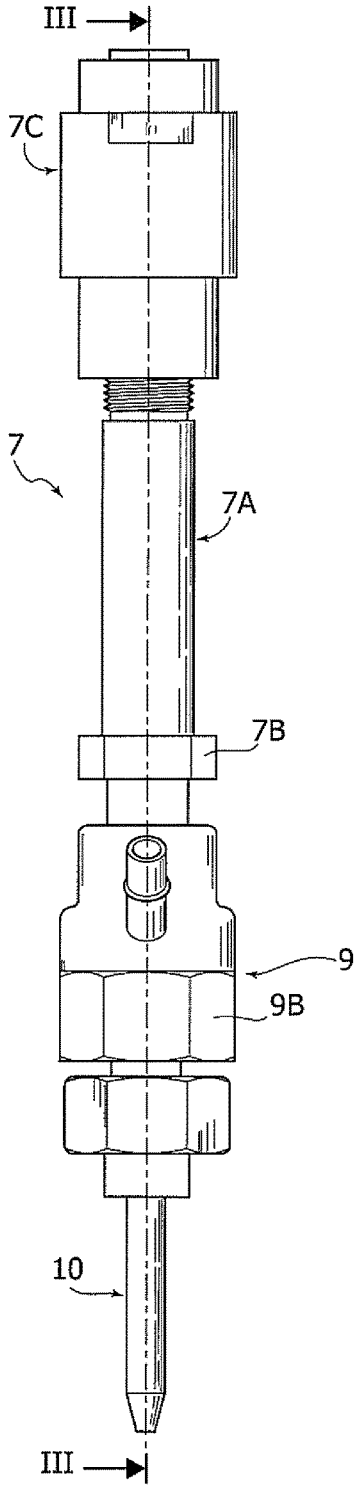
Prior Art FIG. 2
FIG. 2 is an elevational view of a water-jet operating head according to the known art.
Figure 3:
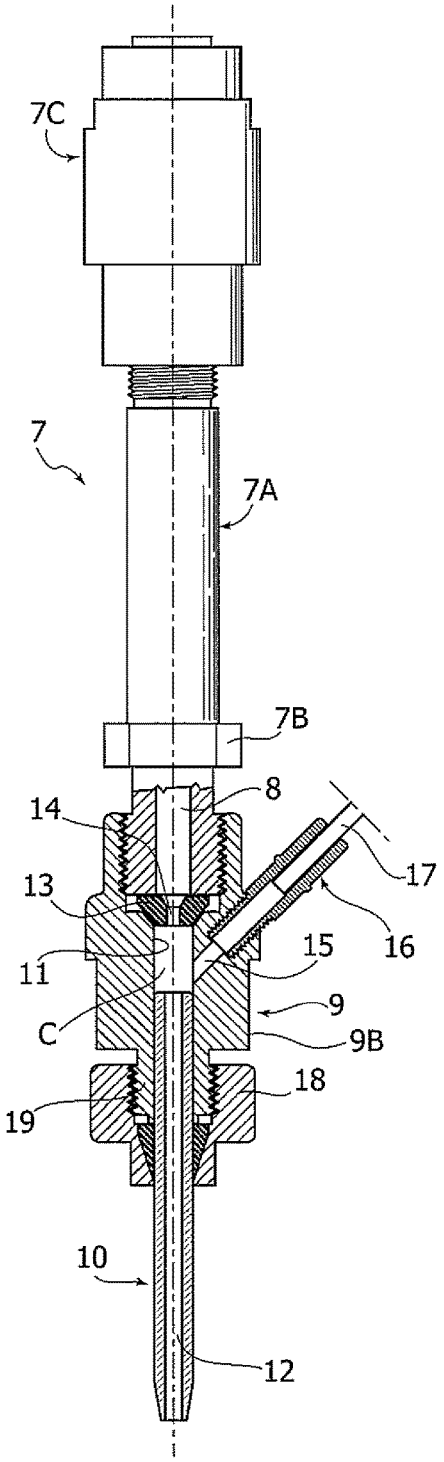
FIG. 3 is a view partially in cross-section, taken along line in FIG. 2, of the known operating head.

FIGS. 2 and 3 show a typical example of a water jet head according to the prior art. With reference to these figures, the head, generally designated by reference numeral 7, comprises a main portion 7A which is to be carried by the structure of slide 6 (see FIG. 1) of the machine. The main portion 7A comprises a tubular body defining an axial passage 8 for feeding a high pressure water flow coming from a conduit (not shown) connected to passage 8 by a connecting element 7C.

The main portion 7A of the head ends with a lower end with an outer thread, on which a tubular support 9 is screwed carrying the focusing nozzle 10 of the head, having the function of focusing a coherent jet of water and abrasive which is projected against the piece surface in order to perform cutting of the material to be worked. To this end, the nozzle-carrying support 9 has an upper mouth with an inner thread screwed until the lower end of the main portion 7A and has an inner cylindrical cavity 11, of reduced diameter, within which there is received the body of the focusing nozzle 10. The focusing nozzle 10 has an axial passage 12 for ejecting the hydro-abrasive jet.

Between the lower end surface of the tubular body 7A and the mouth of the cavity 11 of reduced diameter there is interposed a primary nozzle 13, such as in form of a ring, of hard material, having a central orifice 14 with a reduced predetermined diameter, which is for causing an acceleration of the water flow coming from passage 8. The cylindrical cavity 11 defines a mixing chamber C between the primary nozzle 13 and the focusing nozzle 10, for mixing the abrasive material with the water jet. Into chamber C merges a substantially radial hole 15 formed in the tubular support 9, for adding an abrasive agent (such as garnet) to the water jet coming from passage 8. Hole 15 has an enlarged mouth which receives a connecting element 16 to which a tube 17 is connected (shown only partially in FIG. 3) for supplying the abrasive agent. As indicated, it is possible to provide for two connecting elements, arranged diametrically opposite to each other.

The annexed drawings do not show the means for supplying water under pressure and abrasive agent to the head, these means being of any known type.

The body of the focusing nozzle 10 is locked within the nozzle-carrying support 9 by a bush 18 screwed onto a threaded end portion 19 of support 9.

As already clarified in the foregoing description, during use of water jet heads of the type shown in FIGS. 2 and 3 it becomes necessary to periodically replace the parts subject to wear, specifically the focusing nozzle 10, the primary nozzle 13 and support 9 defining the mixing chamber C, in order to avoid a loss of efficiency and precision in the cutting operations.

In order to enable replacement, the entire structure constituted by support 9 with the primary nozzle 13 and the focusing nozzle 10 is dismantled by unscrewing support 9 from the lower end portion of the main portion 7A of the head after which a new structure of the same type can be screwed in place. These operations are performed manually by an operator, engaging an engagement part 7B of the main portion 7A with the aid of a wrench, in order to hold it against rotation, and rotating support 9 with the aid of another wrench, which engages an engagement portion 9B provided on the outer surface of support 9. This operation is relatively cumbersome and time-consuming and further requires, in order to be carried out, that tube 17 for adding the abrasive agent is preliminarily detached from the connecting element 16, which remains associated to support 9 when the latter is removed, to be replaced.

Figure 4:
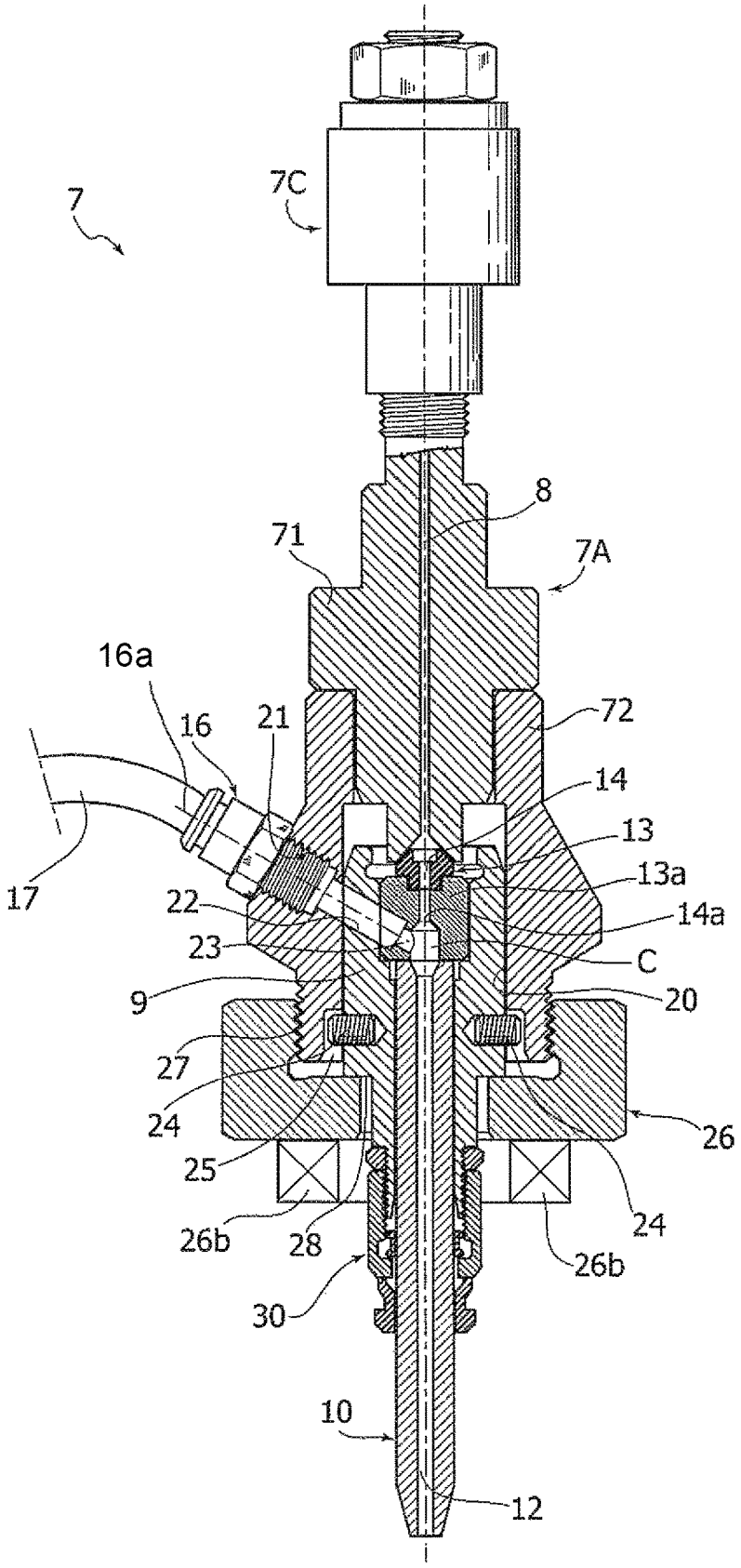
FIG. 4 is a view partially in cross-section of a first embodiment of the water-jet head according to the present invention.

A first embodiment of the invention is shown in FIG. 4 of the annexed drawings and can be used both in a three axis head and in a five axis head. In this figure, parts which are common to those of FIGS. 2 and 3 are designated by the same reference numerals. A first difference with respect to the case of FIGS. 2 and 3 lies in that the connecting element 16 is rigidly connected to the main portion 7A of the head. This of course applies to each connecting element in case there are provided two connecting elements which are diametrically opposite to each other.

In the illustrated example, the main portion 7A has a first element 71, defining the axial passage 8, and a second element 72, of tubular configuration, whose upper end is rigidly connected by an interference fit to the lower end portion of element 71. This arrangement is chosen only for simplifying the construction, while it is clearly understood that, in principle, the two elements 71, 72 could be made in a single piece and together define the main portion 7A of the head, which is not removed when the worn parts are replaced.

The tubular element 72 of the main portion 7A of the head defines a main support, having a cylindrical cavity 20 within which the tubular body of the support 9, carrying the focusing nozzle 10, is adapted to be slidably and removably received. Also in this case, the body of the focusing nozzle 10 defining the passage 12 for ejecting the hydro-abrasive jet is received within the tubular body of support 9. Also in this case, between the lower end surface of the main support 71 and the upper end surface of the focusing nozzle 10 there is interposed the primary nozzle 13 of hard material, with orifice 14 having a predetermined reduced diameter. Furthermore, in the illustrated case, between the primary nozzle 13 and the body of focusing nozzle 10 there is interposed a further primary nozzle 13*a* having an axial orifice 14*a* of reduced diameter, for providing the reduced cross-section for the jet acceleration.

As already indicated above, in the case of the invention the connecting element 16 is carried by the main portion 7A of the head and in particular, in the case of the illustrated example, the connecting element 16 is carried by the main support 72 forming part of the main portion 7A. The connecting element 16 is received within a substantially radial hole 21 formed in the tubular element 72 and aligned with a substantially radial hole 22 formed in the tubular body of support 9 as well as with a substantially radial hole 23 formed in the primary nozzle 13*a*. In this manner, the aligned holes 21,22,23 define an auxiliary passage having an abrasive central inlet axis 16*a* merging into mixing chamber C of the primary nozzle 13*a*, through which the abrasive agent can be added to the high pressure water jet, upstream of passage 12 of the focusing nozzle 10. As already indicated, two connecting elements may be provided, which are diametrically opposite to each other, in which case the above described arrangement of the passages is made for each connecting element.

Support 9 carrying the focusing nozzle 10 and element 72 forming part of the main portion 7A of the head have mutually engagement means cooperating with each other for defining the proper coupling position, in which the holes 21 and 22 are aligned with each other. In the case of the illustrated example, these mutual engagement means comprises two radial grains 24, diametrically opposite to each other, carried by support 9 and projecting radially therefrom. Grains 24 are received within corresponding front slots 25 formed on the lower front surface of the tubular element 72.

Furthermore, preferably the primary nozzle 13 and support 9 have mutually engaging surfaces formed so as to define the proper coupling position in which hole 23 is aligned with hole 22.

Support 9 carrying the focusing nozzle 10 is axially held within the cylindrical cavity 20 of element 72 forming part of the main portion 7A of the head by a rotatable nut ring 26 carried by support 9 and screwed onto a lower threaded portion 27 of the tubular element 72 in order to hold support 9 axially in position, by reacting against an annular shoulder 28 formed on the outer surface of support 9.

In replacement of nut ring 26 any other type of known device could be used, which is adapted to hold the support 9 within cavity 20, while being movable between an operative condition and an inoperative condition. In case it is desired to carry out the nozzle replacement operation in an automatic manner, for example any known coupling device of the type conventionally used in machine tools to enable automatic tool change could be used.

In use of the head of FIG. 4, the high pressure water jet reaches the ejecting passage 12 of the focusing nozzle 10 after passing through passage 8 formed in the main portion 7A of the head, through orifice 14 of the primary nozzle 13 and orifice 14*a* of the primary nozzle 13*a*. The abrasive agent coming from tube 17 is added to the water jet by making it to flow through the connecting element 16 and the aligned holes 21, 22, 23. When wear of the wall of the nozzles 13, 13*a* and passage 12 of the focusing nozzle 10 becomes excessive, these parts can be replaced with simple and quick operations, since it is simply sufficient to unscrew the nut ring 26 and remove support 9, with the focusing nozzle 10 and the nozzles 13, 13*a* carried thereby, with no need of removing tube 17 for the abrasive agent, since the connecting element 16 remains associated to element 72 forming part of the main portion 7A of the head, which has not to be removed. Mounting of a new nozzle only requires the provision of an identical component and insertion of support 9 forming part of this component within cavity 20 of element 72, with subsequent locking by screwing the respective nut ring 26. Naturally, the seal 30 which surround the body of the focusing nozzle 10 and which is carried by support 9 remains always associated to support 9 and the focusing nozzle 10.

Figure 5:
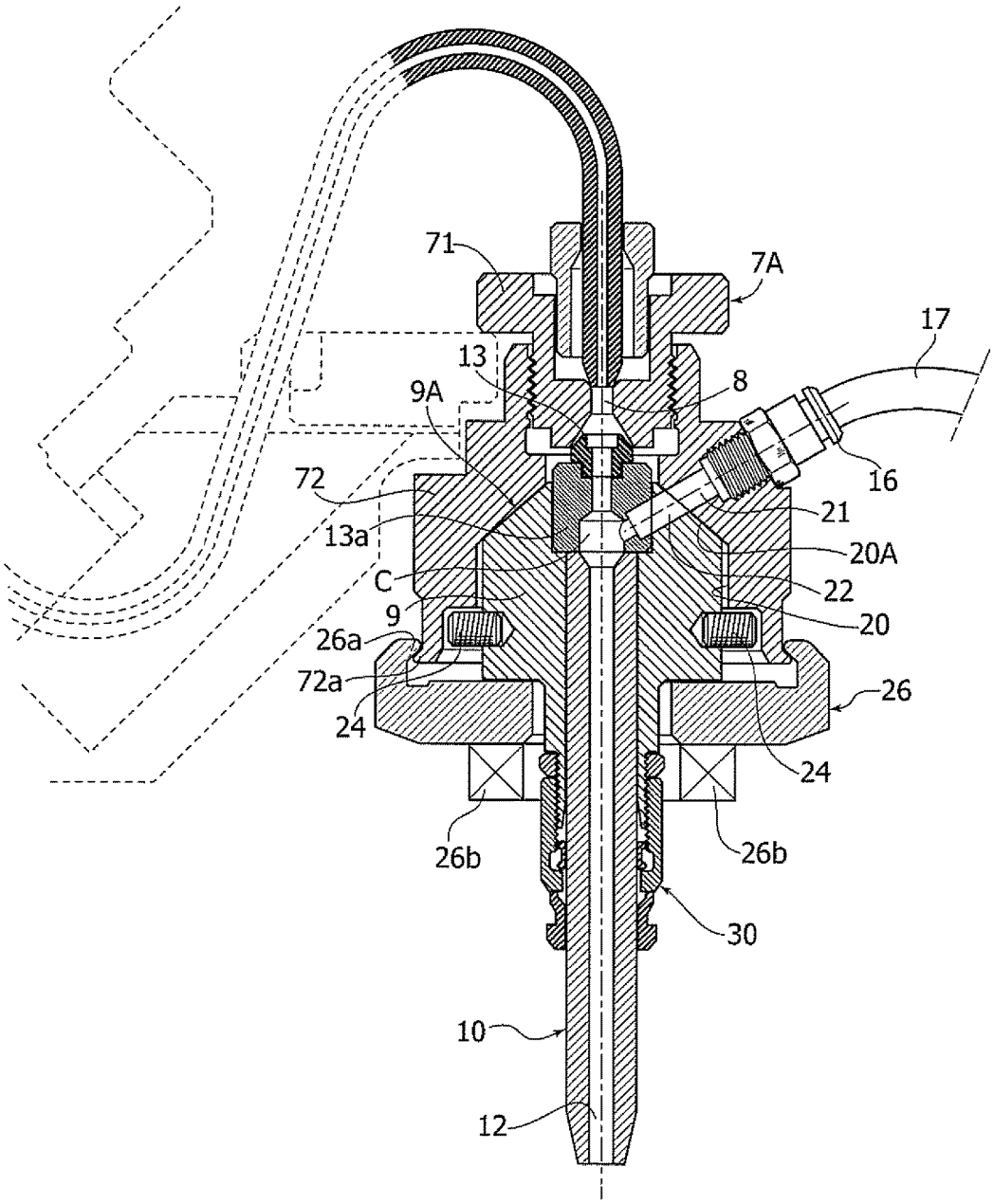
FIG. 5 is a view in cross-section of a second embodiment of the water-jet head according to the present invention.

FIG. 5 shows a second embodiment of the invention which, by way of example, is referred to the case of a five axis head. However, the construction of the head is absolutely identical to that of FIG. 4 (for which reason parts corresponding to those of FIG. 4 have been designated by the same reference numerals).

The only relevant difference with respect to the case of FIG. 4 lies in that in this case the cylindrical body of support 9 carrying the focusing nozzle 10 ends with the conical portion 9*a* which is received within a corresponding conical portion 20A of the cylindrical cavity 20 within which support 9 is slidably mounted. The function of conical portion 9A is to favor the center of cavity 20 at the time of insertion of support 9 within the element 72 of the main portion 7A of the head. For the rest, the head of FIG. 5 differs from that of FIG. 4 only for the configuration of its various elements, which however, are conceptually similar to those of FIG. 4. It is to be stressed in any case that both FIG. 4 and FIG. 5 relate to exemplary embodiments which are provided herein with no limiting intention. For example, also in the solution of FIG. 4 the cylindrical body 9 might be made with a conical end for favoring the center within cavity 20.

In the case of FIG. 5, finally, the locking ring 26 is coupled with element 72 of the main portion 7A of the head by means of a quick-locking thread-like coupling, with one edge 26*a* of the head projecting radially inwardly into engagement on inclined ribs 72*a* formed on the outer cylindrical surface of element 72. Moreover, ring 26 is provided with front engagement portions 26*b*, to be engaged by an operating tool. In this manner, the locking ring can be brought from the released position to the operative locking position by being rotated through an angle lower than 360°.

In general, the locking ring 26 can be constituted by any type of quick locking ring, for example also of a bayonet-like type.

As also indicated, any other type of quick-locking element, as those used for automatic tool change in machine tools and robots, could also be used.

As it is clearly apparent from the foregoing description, the water jet head according to the present invention has a relatively simple structure, constituted by reduced number of parts, but yet ensures a substantially improvement with respect to the heads of known type with regard to simplicity and rapidity of operations which are necessary for replacing the nozzle.

In an electronically controlled machine of the type shown in FIG. 1, the head according to the invention enables the replacement of the worn part of the head to be performed also automatically. To this end, machine 1 includes a magazine area M (see FIG. 1) having one or more empty seats and one or more seats occupied by spare parts, each spare part comprising a nozzle-carrying element 9 with the associated elements 10 and 13 which are subject to wear. The control unit E is programmed for performing an automatic change of the part including the worn elements carried by head 7 by moving head 7 in proximity of an empty seat of magazine M. The locking element 26 of support 9 is brought to its inoperative condition, whereby support 9 (with the focusing nozzle 10 and nozzles 13, 13*a*) is deposited into the empty seat of the magazine. At this time the head is moved over another seat of the magazine which is occupied by a spare part, and is then lowered thereon so as to couple element 72 of the head with support 9 of the spare part. When coupling has been carried out, the locking element 26 is moved to its operative position and the head is brought back to the work position, with the new nozzle mounted thereon.

Naturally, while the principle of the invention remains the same, the details of construction and the embodiments may widely vary with respect to what has been described and illustrated purely by way of example, without departing from the scope of the present invention.

For example, the cavity 20 within the nozzle-carrying support 9 is received may have a non-circular cross-section and a corresponding cross-section may be provided for support 9, so that coupling between these elements also fulfills the function of the above mentioned mutual engagement means which define the proper angular position in which holes 21 and 22 are aligned.

The primary nozzle 13 and the primary nozzle 13*a* can be made in a single piece. Moreover, one of them or both may be made in a single piece with support 9.

Naturally the invention also protects equivalent solutions, such as that in which coupling between the nozzle-carrying support and the main support of the head includes a cavity formed in the nozzle-carrying support adapted to receive therewithin the body of the main support of the head.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A high pressure hydro-abrasive water-jet operating head for use in cutting materials, the operating head comprising:

a head main portion defining a radial hole along an abrasive central inlet axis, the head main portion further having an outer cylindrical surface adjacent a lower front surface, the head main portion defining an internal cylindrical cavity and an axial passage for through passage of high pressure water;

a connecting element mounted to the head main portion in communication with the head main portion radial hole, the connecting element operable to transfer an abrasive through the head main portion into the internal cylindrical cavity;

a nozzle-carrying support defining a radial hole positioned directly adjacent to and in axial alignment with the head main portion radial hole along the abrasive central inlet axis, the nozzle-carrying support operable to transfer the abrasive through the nozzle-carrying support radial hole;

a primary nozzle coupled to the nozzle-carrying support and in selected abutting engagement with the head main portion, the primary nozzle defining a radial hole directly adjacent to and in axial alignment with the nozzle-carrying support radial hole and with a mixing chamber along the abrasive central inlet axis and in communication with the axial passage, the primary nozzle radial hole operable to transfer the abrasive through the primary nozzle to the mixing chamber, the selected abutting engagement of the primary nozzle and the head main portion and the axial alignment of the head main portion radial hole, the nozzle-carrying support radial hole and the primary nozzle radial hole defining a predetermined nozzle-carrying support operably coupled position between the nozzle-carrying support and the head main portion;

a focusing nozzle coupled to the nozzle-carrying support downstream of the primary nozzle;

mutual engaging means defined by the head main portion internal cylindrical cavity and the nozzle-carrying support, wherein on sliding axial positioning of the nozzle-carrying support in the head main portion internal cylindrical cavity, the mutual engaging means operable to automatically position the nozzle-carrying support in the nozzle-carrying support operably coupled position without requiring rotational threaded engagement of the nozzle-carrying support directly with the head main portion; and a locking element movably connected to the nozzle carrying support and independent of the head main portion, the locking element selectively engageable with the head main portion outer cylindrical surface for selectively axially locking of the nozzle-carrying support in the head main portion internal cylindrical cavity in the nozzle operably coupled position in an operative condition and axially unlocking the nozzle carrying support in an inoperative position for rapid removal of the entire nozzle carrying support from the head main portion without removal of the connecting element from the head main portion.

2. The operating head according to claim 1, wherein said primary nozzle comprises a ring and is carried by said nozzle-carrying support so as to remain associated to the latter when the nozzle-carrying support is removed from the head main portion.

3. The operating head according to claim 1, wherein said primary nozzle and said nozzle-carrying support comprise a single piece.

4. The operating head according to claim 1, wherein the nozzle-carrying support comprises a body having a centering conical end facilitating insertion of the nozzle-carrying support within said internal cylindrical cavity of the head main portion main support.

5. The operating head according to claim 1, wherein the head main portion defines two radial holes diametrically positioned relative to one another, the operating head further comprises:

two connecting elements each mounted to the head main portion in a respective head main portion radial hole.

6. The operating head according to claim 1, wherein the locking element further comprises:

a locking ring having a radially inwardly projecting edge; and a radially outwardly extending inclined rib positioned on the head main portion outer cylindrical surface, the locking ring inwardly projecting edge selectively removably engaged with the head main portion inclined rib preventing axial movement of the focusing nozzle with respect to the head main portion.

7. The operating head according to claim 6, wherein said locking ring is rotatable relative to the nozzle-carrying support, the locking ring is further rotatable relative to the head main portion outer cylindrical surface by an angle lower than 360° in order to be moved from the inoperative condition to the operative condition in which it engages on the head main portion for axially locking the nozzle-carrying support in the nozzle-carrying support operably coupled position within the head main portion.

8. The operating head of claim 6 wherein the locking ring is separate and independent of the nozzle carrying support.

9. The operating head of claim 1 wherein the head main portion further comprises:

a first element defining the axial passage; and a second element engaged with the first element, the second element defining the internal cylindrical cavity, the head main portion radial hole and the outer circumferential surface for engagement of the locking ring.

10. The operating head of claim 1 wherein the mutual engaging means further comprises:

the head main portion further comprises a linear open front slot in a lower front surface of the head main portion and in communication with the internal cylindrical cavity, the linear open front slot extending axially upward from the lower front surface and positioned axially adjacent to the locking element; and a grain engaged with and extending radially outward from the nozzle-carrying support, the grain operable to be positioned in the linear open front slot on the axial positioning of the nozzle-carrying support in the internal cylindrical cavity, the grain and linear open front slot operable to automatically position the nozzle-carrying support in the nozzle-carrying support operably coupled position without requiring rotational threaded engagement of the nozzle-carrying support directly to the head main portion for automated changing of the nozzle-carrying support and the primary nozzle.

11. A water-jet cutting machine for use in cutting materials by a high pressure hydro-abrasive jet, the cutting machine comprising:

a bench defining a lateral axis;

a support board positioned on the bench along the lateral axis;

a cross-member slidably mounted to the bench and reciprocally movable along the lateral axis, the cross-member defining a longitudinal axis angularly transverse to the lateral axis;

a carriage connected to the cross-member and reciprocally movable along the longitudinal axis;

a slide connected to the carriage and defining a vertical axis;

a water-jet operating head connected to the slide and reciprocally movable along the vertical axis, the operating head further comprising:

a head main portion connected to the slide defining an axial passage for throughflow of high pressure water, the head main portion defining an internal cylindrical cavity and a radial hole defining an abrasive central axis in communication with the internal cylindrical cavity;

a connecting element connecting an abrasive transfer tube to the head main portion, the connecting element operable to transfer an abrasive through the head main portion radial hole to internal cylindrical cavity;

a nozzle-carrying support defining a radial hole positioned directly adjacent to and axially aligned with the head main portion radial hole along the abrasive central inlet axis, the nozzle carrying support adapted to be selectively axially slidably positioned in the internal cylindrical cavity;

a primary nozzle coupled to the nozzle-carrying support, the primary nozzle in abutting engagement with the head main portion and defining a radial hole positioned directly adjacent to and in axial alignment with the nozzle-carrying support radial hole and a mixing chamber in communication with the axial passage;

a focusing nozzle positioned in the nozzle-carrying support downstream of the primary nozzle;

mutually engaging means for defining a predetermined nozzle-carrying support operably coupled position wherein the primary nozzle is in abutting engagement with the head main portion and the nozzle-carrying support radial hole and the primary nozzle radial hole are positioned in axial alignment with one another along the abrasive central inlet axis without requiring rotational threaded engagement of the nozzle-carrying support directly with the head main portion;

a locking element movably connected to the nozzle-carrying support and separate and independent of the head main portion, the locking element selectively engageable with the head main portion for selectively axially locking the nozzle-carrying support in the internal cylindrical cavity in the nozzle operably coupled position and axially unlocking the nozzle-carrying support in an uncoupled position to remove the nozzle-carrying support from the head main portion without removing the connecting element from the head main portion; and at least one electric motor for selectively moving at least one of the cross-member, carriage or operating head relative to the bench.

12. The cutting machine of claim 11 wherein the mutually engaging means further comprises:

the head main portion further comprises a linear open front slot in a lower front surface of the head main portion and in communication with the internal cylindrical cavity, the linear open front slot extending axially upward from the lower front surface and positioned axially adjacent to the locking element; and a grain engaged with and extending radially outward from the nozzle-carrying support, the grain operable to be positioned in the linear open front slot on the axial positioning of the nozzle-carrying support in the internal cylindrical cavity, the grain and linear open front slot operable to automatically position the nozzle-carrying support in the nozzle-carrying support operably coupled position without requiring rotational threaded engagement of the nozzle-carrying support directly to the head main portion for automated changing of the nozzle-carrying support and the primary nozzle.

13. A high pressure hydro-abrasive water-jet operating head for use in cutting materials, the operating head comprising:

a head main portion defining a radial hole along an abrasive central inlet axis, the head main portion further having a lower front surface and an outer cylindrical surface adjacent the lower front surface, the head main portion defining an internal axial cavity and an axial passage for through passage of high pressure water;

a connecting element mounted to the head main portion in communication with the head main portion radial hole, the connecting element operable to transfer an abrasive through the head main portion into the internal axial cavity;

a nozzle-carrying support defining a radial hole positioned directly adjacent to the head main portion radial hole and in axial alignment therewith along the abrasive central inlet axis, the nozzle-carrying support operable to transfer the abrasive through the nozzle-carrying support radial hole;

a primary nozzle coupled to the nozzle-carrying support and in selected abutting engagement with the head main portion, the primary nozzle defining a radial hole positioned directly adjacent to and in axial alignment with the nozzle-carrying support radial hole and with a mixing chamber along the abrasive central inlet axis and in communication with the axial passage, the primary nozzle radial hole operable to transfer the abrasive through the primary nozzle to the mixing chamber, the selected abutting engagement of the primary nozzle and the head main portion and the axial alignment of the head main portion radial hole, the nozzle-carrying support radial hole and the primary nozzle radial hole defining a nozzle-carrying support operably coupled position between the nozzle-carrying support and the head main portion;

a focusing nozzle coupled to the nozzle-carrying support downstream of the primary nozzle, the nozzle-carrying support, the primary nozzle and the focusing nozzle comprising a pre-assembled singular unit operable to be axially positioned in the head main portion internal axial cavity in the nozzle-carrying support operably coupled position;

a mutual engaging device connected to the nozzle-carrying support, the mutual engaging device selectively positioned in the head main portion linear open front slot to automatically position the nozzle-carrying support pre-assembled singular unit in the nozzle-carrying support operably coupled position without requiring rotational threaded engagement of the nozzle-carrying support directly with the head main portion; and a locking element movably connected to the nozzle carrying support singular pre-assembled unit separate and independent of the head main portion, the locking element selectively engageable with the head main portion outer cylindrical surface for selectively axially locking of the nozzle-carrying support singular pre-assembled unit in the head main portion internal cylindrical cavity in the nozzle-carrying support operably coupled position in an operative condition and axially unlocking the nozzle carrying support singular pre-assembled unit in an inoperative position for rapid removal of the entire nozzle carrying support singular pre-assembled unit from the head main portion without removal of the connecting element from the head main portion.

14. The operating head of claim 13 wherein the mutually engaging device further comprises:

the head main portion further comprising a linear open front slot in the lower front surface extending axially upward from the lower front surface; and a grain connected to and extending radially outward from the nozzle-carrying support, the grain operable to be selectively positioned in the linear open front slot on the axial positioning of the nozzle-carrying support singular pre-assembled unit in the head main portion internal cylindrical cavity thereby positioning the nozzle-carrying support singular assembled unit in the nozzle-carrying support operably coupled position without requiring rotational threaded engagement of the nozzle-carrying support directly with the head main portion.

15. The operating head of claim 14 wherein the primary nozzle further comprises:

a first primary nozzle having a conical-shaped head portion in selected abutting engagement with the head main portion and defining a central orifice in communication with the head main portion axial passage; and a second primary nozzle positioned downstream of the first primary nozzle and in abutting engagement therewith, the second primary nozzle defining an axial orifice in communication with the first primary nozzle central orifice, the second primary nozzle having the mixing chamber and primary nozzle radial hole in communication and axial alignment with the nozzle-carrying support radial hole.

16. The operating head of claim 15 further comprising:

the nozzle-carrying support further defines an interior cavity positioned along the axial passage, the interior cavity having a planar engagement surface; and the second primary nozzle further having a mutually engaging planar surface opposing the nozzle-carrying support interior cavity planar surface, wherein on positioning of the second primary nozzle in the nozzle carrying support interior cavity, the respective planar surfaces automatically align the nozzle-carrying support radial hole with the second primary nozzle radial hole.

17. The operating head of claim 16 wherein the first primary nozzle further comprises a cylindrical portion extending downwardly along the axial passage having a diameter; and the second primary nozzle defines a cavity axially aligned with the conical portion, the first primary nozzle cylindrical portion abuttingly seating in the second primary nozzle cavity and engaging the second primary nozzle on abutting engagement of the first primary nozzle with the head main portion on positioning of the nozzle-carrying portion in the nozzle-carrying support operably coupled position.

* * * * *